US012649977B2

(12) United States Patent
Dotan

(10) Patent No.: US 12,649,977 B2
(45) Date of Patent: Jun. 9, 2026

(54) ELECTROCHEMICAL SYSTEMS AND METHODS OF USE

(71) Applicant: H2PRO LTD, Caesarea (IL)

(72) Inventor: Hen Dotan, Richan (IL)

(73) Assignee: H2PRO LTD, Caesarea (IL)

( * ) Notice: Subject to any disclaimer, the term of this patent is extended or adjusted under 35 U.S.C. 154(b) by 604 days.

(21) Appl. No.: 18/040,189

(22) PCT Filed: Aug. 4, 2021

(86) PCT No.: PCT/IL2021/050946
§ 371 (c)(1),
(2) Date: Feb. 1, 2023

(87) PCT Pub. No.: WO2022/029776
PCT Pub. Date: Feb. 10, 2022

(65) Prior Publication Data

US 2023/0304178 A1 Sep. 28, 2023

Related U.S. Application Data

(60) Provisional application No. 63/060,812, filed on Aug. 4, 2020.

(51) Int. Cl.

| | |
|---|---|
| ***C25B 15/08*** | (2006.01) |
| ***C25B 1/04*** | (2021.01) |
| ***C25B 9/07*** | (2021.01) |
| ***C25B 9/70*** | (2021.01) |

(52) U.S. Cl.
CPC ..... *C25B 15/083* (2021.01); *C25B 1/04* (2013.01); *C25B 9/07* (2021.01); *C25B 9/70* (2021.01); *C25B 15/08* (2013.01); *C25B 15/087* (2021.01)

(58) Field of Classification Search
None
See application file for complete search history.

(56) References Cited

U.S. PATENT DOCUMENTS

| | | | | |
|---|---|---|---|---|
| 7,048,839 | B2 * | 5/2006 | Harada | C25B 9/05 204/266 |
| 10,487,408 | B2 * | 11/2019 | Rothschild | C25B 1/04 |
| 11,050,076 | B1 * | 6/2021 | Wang | H01M 8/188 |
| 11,414,766 | B2 * | 8/2022 | Grader | C25B 1/02 |
| 2003/0141200 | A1 * | 7/2003 | Harada | C25B 1/04 205/637 |
| 2012/0255868 | A1 | 10/2012 | Takeuchi et al. | |

(Continued)

FOREIGN PATENT DOCUMENTS

| | | | |
|---|---|---|---|
| FR | 3 009 654 | A1 | 2/2015 |
| JP | 2003342766 | A | 12/2003 |
| JP | 2006348326 | A | 12/2006 |

(Continued)

OTHER PUBLICATIONS

The International Search Report issued for corresponding PCT/IL2021/050946, mailed Nov. 8, 2021, 2 pages.

*Primary Examiner* — Harry D Wilkins, III
(74) *Attorney, Agent, or Firm* — Vorys, Sater, Seymour and Pease, LLP; Maryellen Feehery Hank

(57) ABSTRACT

Provided is system is described for simultaneously producing hydrogen and oxygen gases. The system includes a plurality of gas-liquid separators configured to separately receive and hold a gaseous component.

15 Claims, 4 Drawing Sheets

(56) References Cited

U.S. PATENT DOCUMENTS

| | | | | |
|---|---|---|---|---|
| 2017/0306510 | A1* | 10/2017 | Rothschild | C25B 1/55 |
| 2021/0017654 | A1* | 1/2021 | Grader | C25B 9/70 |

FOREIGN PATENT DOCUMENTS

| | | | |
|---|---|---|---|
| JP | 2007063113 | A | 3/2007 |
| WO | 2016079746 | A1 | 5/2016 |
| WO | 2019/180717 | A1 | 9/2019 |

* cited by examiner

ELECTROCHEMICAL SYSTEMS AND METHODS OF USE

TECHNOLOGICAL FIELD

The invention generally concerns an improved system for generation of oxygen and hydrogen gases.

BACKGROUND

Recently, an electrochemical thermally activated chemical cell (E-TAC) and a system comprising a plurality of such electrochemical cells was developed [1,2]. In accordance with the technology, hydrogen gas is generated in an electrochemical step on a cathode electrode, in the presence of an applied bias, optionally by water reduction, whereas oxygen gas is generated in a spontaneous chemical step, in the absence of bias, or by increasing the system temperature. In producing oxygen, the anode is allowed to also undergo regeneration and the process to be repeated.

By manipulating and controlling the operation in a system comprised of multiple cells, hydrogen gas is generated in some of the cells and oxygen gas may be simultaneously generated in other cells, while the production of each of the gases may subsequently be changed such that in cells which have produced hydrogen gas, oxygen gas may be produced and vice versa. This permits generation of hydrogen gas in some of the cells simultaneously to the generation of oxygen gas in other cells, allowing continuous hydrogen gas production, while avoiding mixing of the two gases.

REFERENCES

[1] WO 2016/079746
[2] WO 2019/180717

GENERAL DESCRIPTION

In an electrochemical thermally activated chemical cell (E-TAC) system, an electrolyte exchange is carried out in order to complete the production cycle; namely in order to produce both hydrogen and oxygen gases. As demonstrated in FIG. 1, the E-TAC system (120) comprises, in the particular embodiment, two E-TAC reactor cells (reactors 130 and 140), gas-liquid separators (170) and (180) and a pipe assembly connecting the reactor cells and the separators. The pipe assembly contains three distinct piping circuits (501), (502) and (503), each connected to a gas-liquid separator (170) and (180). The system also comprises a leftover separator (190) or an assembly of separators, in a form of a plurality or (one or more) containers or vessels that are connected to the same piping circuit (not shown). The gas-liquid separators provide distinct electrolyte reservoirs which contain oxygen (170), hydrogen (180) or small residues of both (190). The electrolyte temperature is maintained below 60° C., in the case of the hydrogen gas-liquid separator, or above 60° C., in the case of the oxygen gas-liquid separator.

A system of the invention comprises multiple cells, e.g., a plurality thereof or at least two cells or two or more such cells, each being in the form of a compartment/container comprising at least one electrode assembly and configured for holding an aqueous solution. The number of cells in a system of the invention may vary based on, inter alia, the intended operation, operational patterns, etc. Each of the cells may comprise one or more reactors, wherein all reactors in a cell operate in the same way. Different sets (each containing same or different number of reactors) may operate differently.

Each cell or "reactor" is configured to have a dual function such that during application of electric bias to the cell (bias ON) hydrogen gas may be generated and in the absence of an applied bias (bias OFF) spontaneous generation of oxygen gas may take place. The reactor is typically non-partitioned.

In some embodiments, the two or more cells, in accordance with the present disclosure, are separated, having essentially no fluid or gas communication therebetween.

As detailed herein, each of the two or more cells comprises an electrode assembly that includes an anode and a cathode and thus can serve as a single independent unit, configured for generation of both hydrogen gas and oxygen gas. It should be noted that each of the two or more cells is not a half-cell comprising an electrode and an electrolyte. In some embodiments, the electrode assembly is selected from a mono-polar assembly, a bi-polar assembly, a flat assembly and a rolled assembly.

The electrode assembly comprises a cathode that in the presence of bias generates hydrogen gas optionally by reducing water and further brings about generation of hydroxide ions. Generation of hydrogen gas may be under basic pH, acidic pH or natural pH. Thus, the water medium may be acidic, neutral or basic, may be selected from tap water, sea water, carbonate/bicarbonate buffers or solutions, electrolyte-rich waters, etc. In some embodiments, the cathode is configured to affect reduction of water molecules to generate hydrogen gas and optionally hydroxide ions. In some other embodiments, the cathode reduces hydrogen ions in an aqueous solution to generate hydrogen gas. The cathode may be of a material selected from a metal and electrode materials used in the field. The electrode material may, for example, be selected from nickel, Raney nickel, copper, graphite, platinum, palladium, rhodium, cobalt, $MoS_2$ and their compounds. In some embodiments, the electrode material is not cadmium (Cd) or does not comprise cadmium. In some embodiments, the cathode consists Raney nickel, copper, graphite or platinum.

While the anode may comprise or may consist identical electrode materials as the cathode, the material of the anode must permit at least one redox cycle (reaction), i.e., oxidation, reduction, in accordance with the invention. In other words, the anode in accordance with the invention is capable, under conditions described herein, of reversibly undergoing an oxidation step in the presence of applied bias (anode charging) and a subsequent reduction step in the absence of bias (anode regeneration), to generate oxygen gas. This may be optionally followed by a further redox cycle.

The "gas-liquid separator" is a device or a vessel used to separate a gas-liquid mixture into its constituent phases. The separator vessel may be vertically oriented or horizontally oriented, and can act as a 2-phase or 3-phase separator. Gravity is utilized to cause the denser component or phase, typically the liquid phase to settle to the bottom of the vessel from where it is withdrawn, while the less dense component or phase, being the gas, is withdrawn from the top of the vessel. A separator configured to receive a gas-liquid mixture comprising hydrogen gas is referred to herein as a hydrogen gas-liquid separator; and similarly a separator configured to receive oxygen gas is referred to herein as an oxygen gas-liquid separator. As will be further disclosed herein, when referencing to a leftover separator, the separator is a vessel configured to receive and hold a liquid phase that is substantially free of gases or which comprises minute amounts of the gas(es), as disclosed herein.

Thus, a system of the invention for producing hydrogen and oxygen gases comprises at least two reactor cells; and a plurality of gas-liquid separators. The plurality of separators include:

- one or more hydrogen gas-liquid separator, each being configured to receive and hold hydrogen gas and a liquid phase comprising dissolved hydrogen and electrolytes;
- one or more oxygen gas-liquid separator, each being configured to receive and hold oxygen gas and a liquid phase comprising dissolved oxygen and electrolytes; and
- one or more leftover separator, each being configured to receive and hold a gas-free liquid, i.e., free of oxygen and/or hydrogen, or to hold a liquid that comprises an amount below (or not higher than) 4% v/v of hydrogen gas and/or oxygen gas.

As arises from the system depicted in FIG. 1, valves present at the input and output of each of the E-TAC cells connect the cell(s) to the different electrolyte circuits. During hydrogen production or oxygen production or during washing of the cells, both the input and the output valves are connected to a particular electrolyte circuit. In other words, during hydrogen production, input and the output valves are set to permit electrolyte communication to and from the hydrogen separator; and during oxygen production, the input and the output valves are set to permit electrolyte communication to and from the oxygen separator. Direct switching between the hydrogen and oxygen production modes leads to electrolyte mixing between the circuits, as the electrolyte within the reactor is transferred from one circuit to the other.

A washing step between hydrogen and oxygen production is included in order to avoid gas mixing. In the washing step an electrolyte solution, maintained at a temperature between that used in the hydrogen gas-liquid separator and that used in the oxygen gas-liquid separator, is circulated in the reactor cell(s) and the circuit pipes.

During switching between hydrogen production, oxygen production and washing steps, the content of the operating reactor cell after completion of each production or washing step is pushed out and into the gas-liquid separator of the next production step, thereby greatly influencing the conditions in the recipient separator and leading to a significant heat loss.

To avoid heat loss associated with the switching, the inventors of the technology disclosed herein have modified the process in such a way that the content of the operating reactor cell is pushed out of the reactor and back into the separator maintained at a substantially same temperature and comprising the same gas by using an electrolyte solution from the gas separator associated with the next step. Depending on the mode of operation (hydrogen production, oxygen production or washing), the content of the cell being pushed out is transferred into the respective gas-liquid separator, maintaining the temperature of the liquid in that gas-liquid separator. The volume of electrolyte pushing the cell content is directed back into its separator after completion of the production or washing step, thereby not affecting the temperature in either of the hydrogen, oxygen or washing separators and reducing heat losses.

In a system of the invention, any one of the reactors is connected to each of the separators via a piping assembly, forming three distinct circuits: a hydrogen circuit—wherein a reactor is connected to a hydrogen gas-liquid separator, an oxygen circuit—wherein a reactor is connected to an oxygen gas-liquid separator, and a leftover circuit—wherein a reactor is connected to a leftover gas-liquid separator. Each of the reactors and separators are equipped with input and output valves that control the flow of liquid into and from the reactors.

In an operating system according to the invention, after each gas generation step, producing hydrogen or oxygen gas (utilizing the respective circuit), the reactor is washed with a leftover liquid from the leftover separator. Thus, following completion of a gas generation step (regarded for the sake of brevity as the preceding or previous circuit), the input valve(s) switch from that preceding circuit to the leftover circuit (permitting flow of liquid from the leftover separator), while the reactor output valve(s) stay oriented at the preceding circuit (permitting flow of the reactor content to the separator containing the gas generated through the preceding circuit). The electrolyte from the leftover circuit pushes the electrolyte from the previous circuit out of the reactor and into the separator of the preceding circuit. This step lasts until all the electrolyte in the reactor and the circuit piping is pushed into the separator of the preceding circuit. Once this step is completed the output valve(s) switch to the new circuit (the following gas generation step). For example, at the end of a hydrogen production step, the reactor is full of an electrolyte from the hydrogen circuit. In order to push this electrolyte back into the hydrogen circuit, the reactor input valve(s) switch to the leftover circuit. The electrolyte from the leftover circuit pushes the electrolyte from the hydrogen circuit out and into the hydrogen separator. Once all the electrolyte from the hydrogen circuit is pushed out, the output valves switch to the leftover circuit and the content of the reactor is now pushed back into the leftover separator.

The same steps are repeated for the oxygen generation mode, utilizing the oxygen separator and circuit and the leftover separator and circuit.

Each of the steps utilizing the leftover electrolyte is referred to herein as a "push step". There are thus two different "push steps". One "push step" is regarded as "positive and the other as "negative". In a "positive" push step, a liquid from the leftover separator is pushed into the reactor, thereby pushing out the reactor content to the separator of the preceding circuit (hydrogen or oxygen). Thus, when the preceding circuit was hydrogen and the reactor is full with a hydrogen electrolyte, the input valve(s) is oriented to permit pushing of the hydrogen electrolyte from the reactor through the output valve(s) into the hydrogen circuit and the hydrogen separator. This push step will be referred to herein as a hydrogen positive push step. In a similar way, where the preceding production mode was oxygen production, the push step will be referred to herein as an oxygen positive push step.

In the "negative" push step, the reactor is full of a leftover electrolyte and is ready to accept an electrolyte of the next operational mode. Where the next operational mode is hydrogen production, the reactor input valve(s) will be oriented to allow flow of a hydrogen electrolyte into the reactor, thereby pushing the reactor content into the leftover separator. The output valve(s) will be oriented to allow electrolyte flow into the leftover separator. This push step is regarded herein as a hydrogen negative push step. In a similar way, where the next production mode is oxygen production, the push step will be referred to here as an oxygen negative push step.

The four push steps are summarized in Table 1 and depicted in FIGS. 2A-D.

| Step name | Input valve orientation | Output valve orientation |
|---|---|---|
| $H_2$ positive = "+"$H_2$ | Leftover circuit | $H_2$ circuit |
| $H_2$ negative = "−"$H_2$ | $H_2$ circuit | Leftover circuit |
| $O_2$ positive = "+"$O_2$ | Leftover circuit | $O_2$ circuit |
| $O_2$ negative = "−"$O_2$ | $O_2$ circuit | Leftover circuit |

In a simplistic cyclic system operation, the following sequence is circularly followed: $H_2$ production→$H_2$ positive push step→leftover wash→$O_2$ negative push step→$O_2$ production→$O_2$ positive push step→leftover wash→$H_2$ negative push step; and repeated. Where the system comprises multiple reactors and washing vessels, the operation sequence, while being substantially based on the same principals, becomes more complex, as further discussed below.

Each of the push steps, while preventing the mixing of electrolytes, and reducing heat losses in the washing steps, leads to a temporal change in the electrolyte volume(s) within the circuit. The increase in the electrolyte volume in any of the separators may lead to an increase in circuit pressure and electrolyte level in the separator. Such an increase in pressure or liquid level can impinge on the electrolyte flow speed, electrolyte level differences between the different separators, pressure differences between the circuits and as a result may cause malfunction of the system.

In order to overcome these temporal changes, the system is adapted with a mechanical device, e.g., a reciprocal device, configured and operable to react to such changes in volume and liquid levels, and effectively reduce or diminish pressure fluctuations and avoid system malfunction. The mechanical means may be any such means that reduce changes in the separators and/or that cause a change (decrease or increase) in the separator size or volume. The mechanical means may be provided with a valve or a valve assembly which permits detouring or functionally disabling the means from operation.

For reducing pressure and level changes, each of the separators may be equipped with an external loop or an auxiliary member or a linear or non-linear pressure activated device or mechanism that is configured and operable for reacting to an increase in pressure and for reducing such pressure changes and fluctuations caused by an inlet flow into the separator. The pressure activated device or mechanism may be in any form known in the art.

In some embodiments, the external member or auxiliary member may be in a form of a container or a volume member capable of receiving and holding an amount of the liquid contained within a separator. The size and shape of the member may be designed to permit receiving and holding of the liquid volume and emptying said volume upon need.

In other embodiments, the pressure activated device or mechanism may be connecting a leftover gas-liquid separator (being an electrolyte reservoir) and oxygen and hydrogen separators (or electrolyte reservoirs) as shown in FIG. 3A. Multiple pressure activated devices may as also be used between multiple leftover gas-liquid separators as shown in FIG. 3B. An external loop connecting between leftover gas-liquid separator and hydrogen gas-liquid separator presented in FIG. 3C is an example of such pressure activated mechanism.

In other embodiments, the pressure activated device or mechanism may be a reciprocating device or a pressure equilibrator in a form of a piston connecting a leftover gas-liquid separator (being an electrolyte reservoir) and oxygen and hydrogen separators (or electrolyte reservoirs). The piston may be positioned at a top part of the separator, at a region of the separator occupied by a gas phase or at a lower part of the separator occupied by a liquid phase, as shown in FIGS. 4 and 5.

As the electrolyte volume and pressure changes during the push step, the pistons move in the direction of pressure to cancel the pressure difference in the separators. The design shown in FIG. 5 also permits canceling of the electrolyte level differences which might result. The piston needs to be able to adjust its position to the volume change that takes place during the system push steps (i.e., positive and negative, as defined). Therefore, the piston volume is selected to be proportional to the electrolyte volume inside the reactors and the maximum number of positive and negative push steps that take place at the same time.

In other embodiments, the reactors maybe organized as sets of reactors which are connected at their inputs and outputs as shown in FIG. 6. These reactors operate as a single unit (one big reactor).

In general terms, the volume of the pressure activated device or mechanical device disclosed herein may be calculated according to equation Eq. 1 below. It is important to note that in some configurations, the push sequences may result in a volume that is substantially zero as volumes of a positive and a negative push steps in a given sequence are the same.

$$\text{volume}_{(H2\ or\ O2\text{-}leftover)} = \left\| \text{“+”}_{(H2\ or\ O2)} - \text{“−”}_{(H2\ or\ O2)} \right\| \times \text{Set or Reactor volume} \qquad \text{Eq. 1:}$$

Where the device is a piston, the volume determined above is a volume of a piston.

In a non-limiting example, in a system according to the invention, having 8 reactors, each comprising an electrolyte volume of 1 liter, if the system operation requires a maximum of 4 hydrogen positive push steps at the same time, and no negative push steps, the mechanical device associated with the hydrogen-leftover, e.g., piston, needs to be at least 4 liters in volume. Where the number of positive and negative push steps is the same, the volume may be zero. Thus, a mechanical device, such as a piston or any other equivalent device, may not be needed.

Where negative push steps are involved together with positive push steps, the mechanical device, e.g., piston volume may be reduced. For example, in a system with 200 reactors, each of the reactors having an electrolyte volume of 10 liters, if the system operation requires a maximum of 25 hydrogen positive push steps, and at the same time also 20 hydrogen negative push steps, than the hydrogen-leftover mechanical device, e.g., piston needs to be at least 50 liters in volume. In a similar example 200 reactors are assembled in 40 sets, 5 reactors in each set. In this case the operation will require a maximum of 5 hydrogen positive push steps, and at the same time also 4 hydrogen negative push steps, than the hydrogen-leftover mechanical device, e.g., piston needs to be at least 50 liters in volume similar to the previous example.

This concept can be broadened by planning a multi reactor (or sets of reactors) operating sequence in which a positive and negative push step takes place at the same time. An example of such operating sequence with four reactors (or sets of reactors) is presented in Table 2 below. The sequence demonstrates continuous and uninterrupted operation of the four reactors to simultaneously produce both hydrogen and oxygen gases. As hydrogen gas evolution takes place under bias and oxygen generation occurs in the absence of bias, and in order to collect residual amounts of hydrogen at the end of each hydrogen production cycle, each of the cells is circulated with the hydrogen electrolyte solution (the so-called $H_2$ Circulation), in the absence of bias.

TABLE 2

| Step | Cell 1 | Cell 2 | Cell 3 | Cell 4 |
|---|---|---|---|---|
| 1 | leftover wash | $O_2$ Production | $H_2$ Circulation | $H_2$ Production |
| 2 | leftover wash | $O_2$ Production | $H_2$ Production | $H_2$ Production |
| 3 | leftover wash | $O_2$ Production | $H_2$ Production | $H_2$ Production |
| 4 | $O_2$ Negative | $O_2$ Positive | $H_2$ Production | $H_2$ Production |
| 5 | $O_2$ Production | leftover wash | $H_2$ Production | $H_2$ Production |
| 6 | $O_2$ Production | leftover wash | $H_2$ Production | $H_2$ Production |
| 7 | $O_2$ Production | leftover wash | $H_2$ Production | $H_2$ Circulation |
| 8 | $O_2$ Production | $H_2$ Negative | $H_2$ Production | $H_2$ Positive |
| 9 | $O_2$ Production | $H_2$ Circulation | $H_2$ Production | leftover wash |
| 10 | $O_2$ Production | $H_2$ Production | $H_2$ Production | leftover wash |
| 11 | $O_2$ Production | $H_2$ Production | $H_2$ Production | leftover wash |
| 12 | $O_2$ Positive | $H_2$ Production | $H_2$ Production | $O_2$ Negative |
| 13 | leftover wash | $H_2$ Production | $H_2$ Production | $O_2$ Production |
| 14 | leftover wash | $H_2$ Production | $H_2$ Production | $O_2$ Production |
| 15 | leftover wash | $H_2$ Production | $H_2$ Circulation | $O_2$ Production |
| 16 | $H_2$ Negative | $H_2$ Production | $H_2$ Positive | $O_2$ Production |
| 17 | $H_2$ Circulation | $H_2$ Production | leftover wash | $O_2$ Production |
| 18 | $H_2$ Production | $H_2$ Production | leftover wash | $O_2$ Production |
| 19 | $H_2$ Production | $H_2$ Production | leftover wash | $O_2$ Production |
| 20 | $H_2$ Production | $H_2$ Production | $O_2$ Negative | $O_2$ Positive |
| 21 | $H_2$ Production | $H_2$ Production | $O_2$ Production | leftover wash |
| 22 | $H_2$ Production | $H_2$ Production | $O_2$ Production | leftover wash |
| 23 | $H_2$ Production | $H_2$ Circulation | $O_2$ Production | leftover wash |
| 24 | $H_2$ Production | $H_2$ Positive | $O_2$ Production | $H_2$ Negative |
| 25 | $H_2$ Production | leftover wash | $O_2$ Production | $H_2$ Circulation |
| 26 | $H_2$ Production | leftover wash | $O_2$ Production | $H_2$ Production |
| 27 | $H_2$ Production | leftover wash | $O_2$ Production | $H_2$ Production |
| 28 | $H_2$ Production | $O_2$ Negative | $O_2$ Positive | $H_2$ Production |
| 29 | $H_2$ Production | $O_2$ Production | leftover wash | $H_2$ Production |
| 30 | $H_2$ Production | $O_2$ Production | leftover wash | $H_2$ Production |
| 31 | $H_2$ Circulation | $O_2$ Production | leftover wash | $H_2$ Production |
| 32 | $H_2$ Positive | $O_2$ Production | $H_2$ Negative | $H_2$ Production |

Such a sequence allows the "volume" of the device or means, e.g., piston, to become negligible, as explained herein.

In some embodiments, the piston may be in the form of a spool-type movable element or a poppet-type movable element.

The pressure activated device or mechanical device may alternatively be in a form of tubing or a channel that connects the gas-liquid separators, as described above. The tubing or channel may be of a sufficiently large volume selected to react to a pressure producing displacement of an entire reactor volume of liquid. The tubing or channel may be configured and operable to hold a volume of liquid from each of the separators and operate, upon an increase in the pressure in one of the separators, operate as a piston flow unit or as a plug flow unit. In cases where the two liquids are to be separated, the tubing or channel may be equipped with a movable solid barrier which position along the length of the tubing or channel is changed in response to pressure.

Alternatively to providing the separators with pressure activated devices or mechanisms, for reducing pressure and level changes in each of the separators, any two separators, as detailed above, may be associated with a pair of containers or receptacles of a volume and size sufficient to contain at least a reactor volume amount.

Alternatively to equipping the separator(s) with a pressure reducing valve, e.g., a piston, the separator(s) may be configured and operable to react to a change in pressure or a change in volume or a change in the liquid level by changing their size or volume. In other words, by utilizing one or more separators that are capable of changing their size (and therefore their effective volume) or the internal volume (and therefore their effective volume), the effect of pressure fluctuations and/or of liquid level may be reduced or diminished. The separator(s) size or volume may increase or decrease so as to cancel the pressure difference in the separators.

Thus, in an aspect thereof, the invention provides a system for producing hydrogen and oxygen gases, the system comprising:

at least two reactor cells; and a plurality of gas-liquid separators comprising:

one or more hydrogen gas-liquid separator, each being configured to receive and hold hydrogen gas and a liquid phase comprising dissolved hydrogen and electrolytes;

one or more oxygen gas-liquid separator, each being configured to receive and hold oxygen gas and a liquid phase comprising dissolved oxygen and electrolytes; and one or more leftover gas-liquid separator, each being configured to receive and hold a gas-free liquid, i.e., free of oxygen and/or hydrogen, or to hold a liquid that comprises an amount below (or not higher than) 4% v/v of hydrogen gas and/or oxygen gas;

wherein each of the at least two reactor cells is provided with an outlet configured and operable to discharge a fluid and a feed inlet for flowing in a fluid; and wherein at least one of the plurality of gas-liquid separators is adapted with a mechanical means configured and operable to reduce pressure changes in the at least one gas-liquid separator in response to pressure fluctuations, e.g., derived from discharging the reactor content to the gas-liquid separator.

In some embodiments, each of the at least two reactor cells is provided with a feed outlet configured and operable to discharge a gas-containing content to a gas-liquid separator comprising the same gas, and with a feed inlet for flowing a leftover liquid into the reactor, for displacing the full reactor content with a leftover liquid from the one or more leftover gas-liquid separator.

In some embodiments, one or more of the oxygen gas-liquid separator and one or more of the hydrogen gas-liquid separator are connected via said mechanical means to one or more of the leftover gas-liquid separator.

In some embodiments, each of the at least two reactor cells is configured and operable to discharge hydrogen and liquid content to a hydrogen gas-liquid separator, by actively displacing the full reactor cell content with a liquid from the one or more leftover gas-liquid separator; followed by replacing the leftover liquid in the reactor cell with a liquid from the oxygen gas-liquid separator.

In some embodiments, each of the at least two reactor cells is configured and operable to discharge oxygen and liquid content to an oxygen gas-liquid separator, by actively displacing the full cell content with a liquid from the one or more leftover gas-liquid separator; followed by replacing the leftover liquid in the reactor cell with a liquid from the hydrogen gas-liquid separator.

In some embodiments, the mechanical means is a pressure equalizer device configured and operable for reducing pressure caused by an inlet flow into a separator.

In some embodiments, the pressure equalizer device is a piston connecting a leftover gas-liquid separator and a hydrogen or oxygen gas-liquid separator. The piston is adapted for reacting to pressure changes in the hydrogen or oxygen gas-liquid separator or in the leftover separator and equilibrate said pressure.

In some embodiments, the volume of the mechanical device, as defined herein, e.g., piston, is selected to be proportional to the electrolyte volume in the reactor and to the number of input and output cycles.

In some embodiments, the mechanical means is in a form of a size- or volume-modifiable gas-liquid separator that is capable of reacting to pressure fluctuations by increasing or decreasing its size or volume.

As used herein, any of the gas-liquid separators used in a system of the invention comprises a gaseous component, i.e., hydrogen, oxygen or a mixture of both, and a liquid component, i.e., a liquid carrier such as water which comprises soluble electrolytes and a certain amount of the gaseous component in dissolved form. Separation of the gaseous component from the liquid component operates on the grounds of gravity, wherein in a vertical vessel used in the process the liquid in the mixture settle down at the bottom of the vessel and the gaseous component rises to the upper portion of the separator vessel. The liquid component may be withdrawn through a valve or a pipe assembly positioned at the bottom part of the separator vessel or at any region of the separator which is in direct contact with the liquid. The gaseous component may be removed from an outlet valve positioned at the top portion of the vessel.

Where gas-liquid separators of other configurations are used, the position of the valves may change.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which:

FIG. 2A depicts $H_2$ positive push, FIG. 2B depicts $H_2$ negative push, FIG. 2C depicts $O_2$ positive push and FIG. 2D depicts $O_2$ negative push.

FIG. 3A shows a general depiction of such a system; FIG. 3B depicts a non-limiting example of an assembly such a device in a system of the invention. FIG. 3C shows a non-limiting example of a device in a form of an external loop.

DETAILED DESCRIPTION OF EMBODIMENTS

Figure 1:
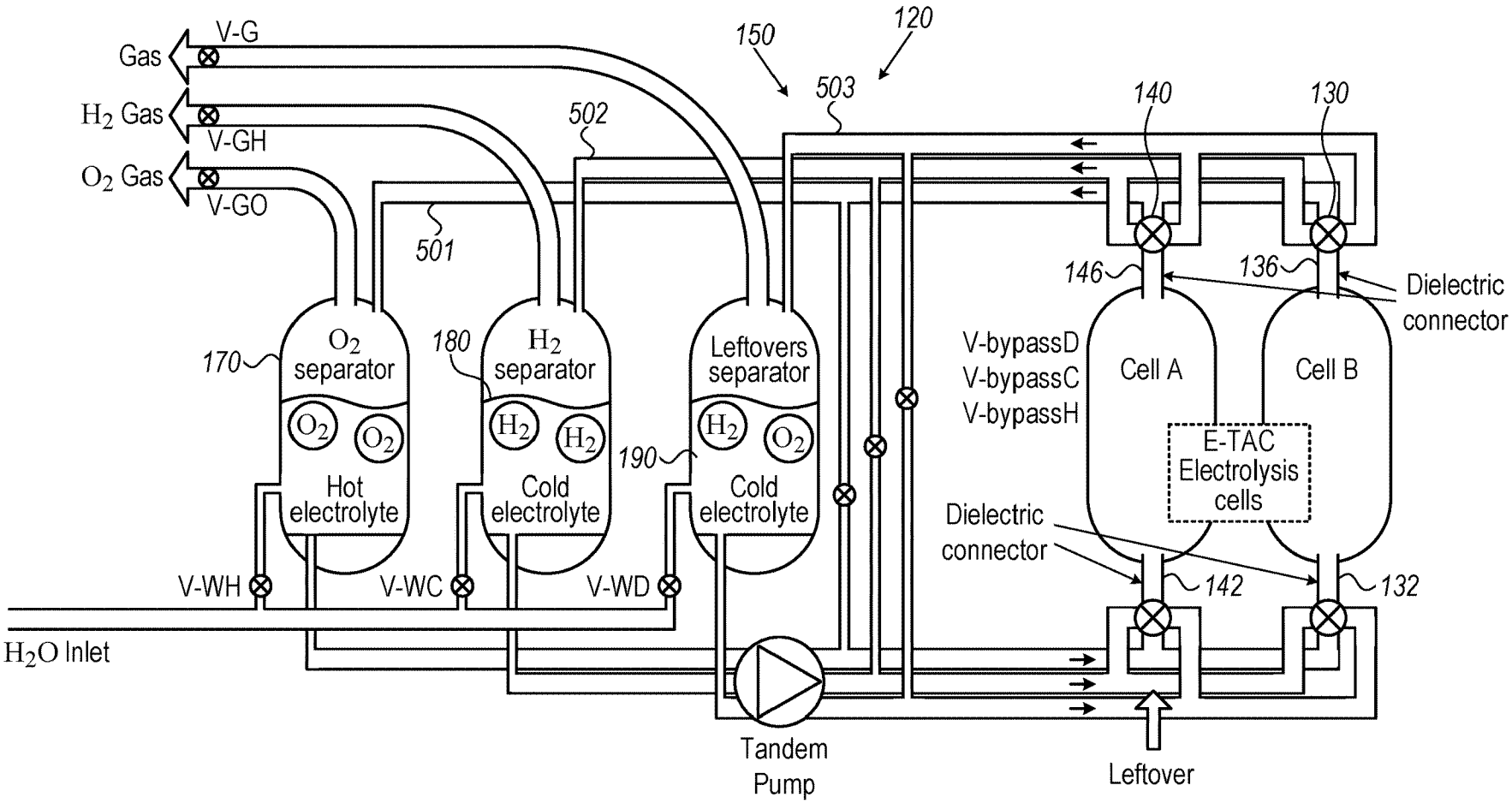
FIG. 1 is a schematic representation of a system according to some embodiments of the invention.

An exemplary system (120) according to the invention is exemplified in FIG. 1. The system (120) comprises, in the particular embodiment, two E-TAC reactor cells (reactors 130 and 140), gas-liquid separators (170) and (180) and a pipe assembly connecting the reactor cells and the separators. The pipe assembly (150) contains three distinct piping circuits (501), (502) and (503), each connected to a gas-liquid separator (170) and (180). The system also comprises a leftover separator (190) or an assembly of separators, in a form of a plurality (one or more) of containers or vessels that are connected to the same piping circuit (not shown). The gas-liquid separators provide distinct electrolyte reservoirs which contain oxygen (170), hydrogen (180) or small residues of both (190). The electrolyte temperature is maintained below 60° C., in the case of the hydrogen gas-liquid separator, or above 60° C., in the case of the oxygen gas-liquid separator.

Figures 2A, 2B, 2C, 2D:
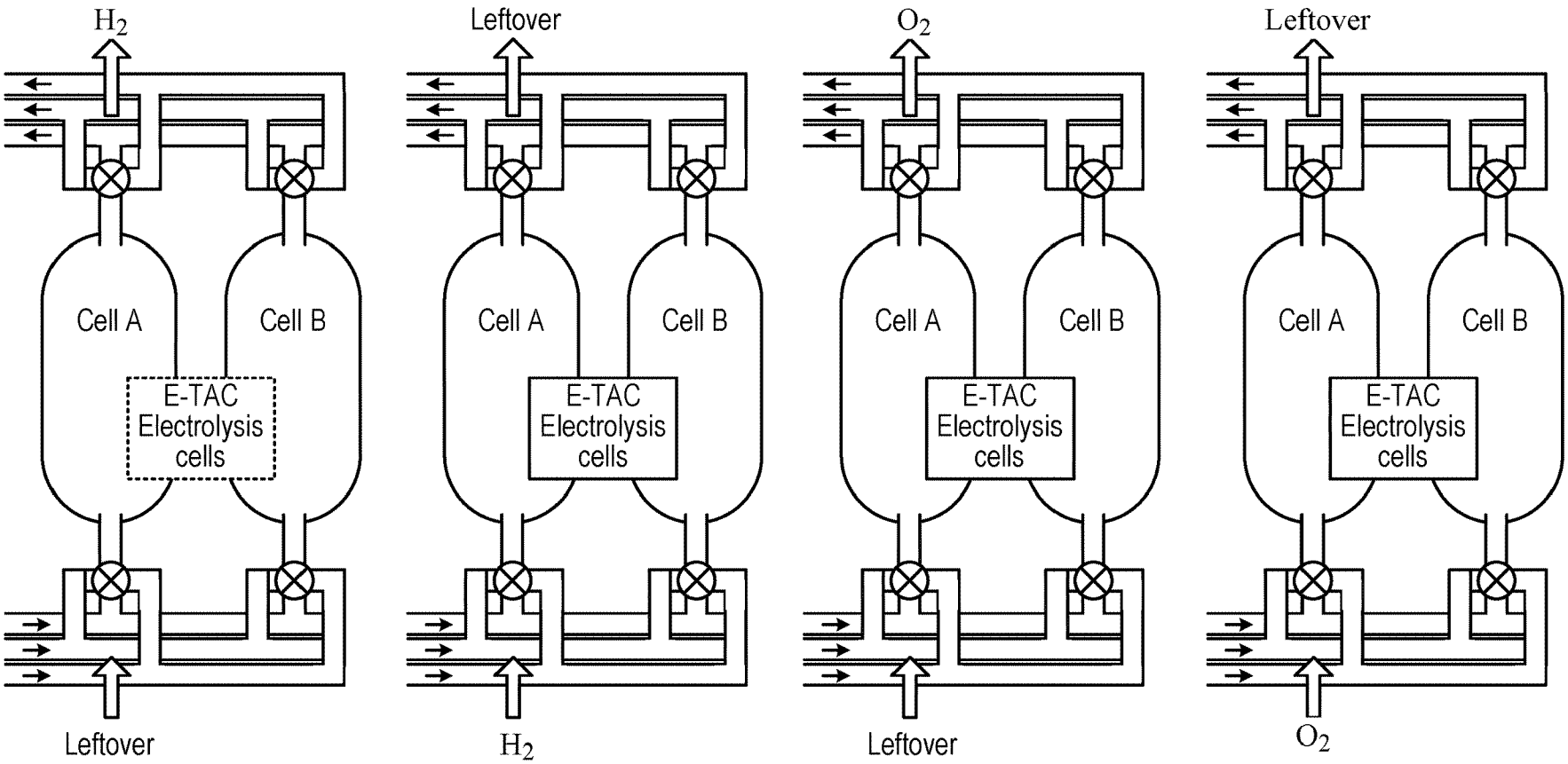
FIGS. 2A-D provide a schematic depiction of each of the four push steps summarized in Table 1.

Reference is now made also to FIGS. 2A-2D showing zoom in views of the system (120) of FIG. 1. In the operating exemplary system, after each gas generation step, producing hydrogen or oxygen gas (utilizing the respective circuit), the reactor is washed with a leftover liquid from the leftover separator (190). Thus, following completion of a gas generation step, the input valve(s) switch from that preceding circuit to the leftover circuit (permitting flow of liquid from the leftover separator), while the reactor output valve(s) stay oriented at the preceding circuit (permitting flow of the reactor content to the separator containing the gas generated through the preceding circuit), as shown in FIGS. 2A and 2C. The electrolyte from the leftover circuit pushes the electrolyte from the previous circuit out of the reactor and into the separator of the preceding circuit. This step lasts until all the electrolyte in the reactor and the circuit piping is pushed into the separator of the preceding circuit. Once this step is completed the output valve(s) switch to the new circuit (the following gas generation step). For example, at the end of a hydrogen production step, the reactor is full of an electrolyte from the hydrogen circuit. In order to push this electrolyte back into the hydrogen circuit, the reactor input valve(s) switch to the leftover circuit. The electrolyte from the leftover circuit pushes the electrolyte from the hydrogen circuit out and into the hydrogen separator. Once all electrolyte from the hydrogen circuit is pushed out, the output valves switch to the leftover circuit and the content of the reactor is now pushed back into the leftover separator, as shown in FIGS. 2B and 2D. such a sequential operation, which may be repeated for the oxygen generation mode, utilizing the oxygen separator and circuit and the leftover separator and circuit, ensures the generated reactors are not mixed, increases gas yield and reduces energy losses, as further explained herein. In systems comprising more than two reactors, the ideas described above are repeated for each set of reactors and separators.

Figure 6:
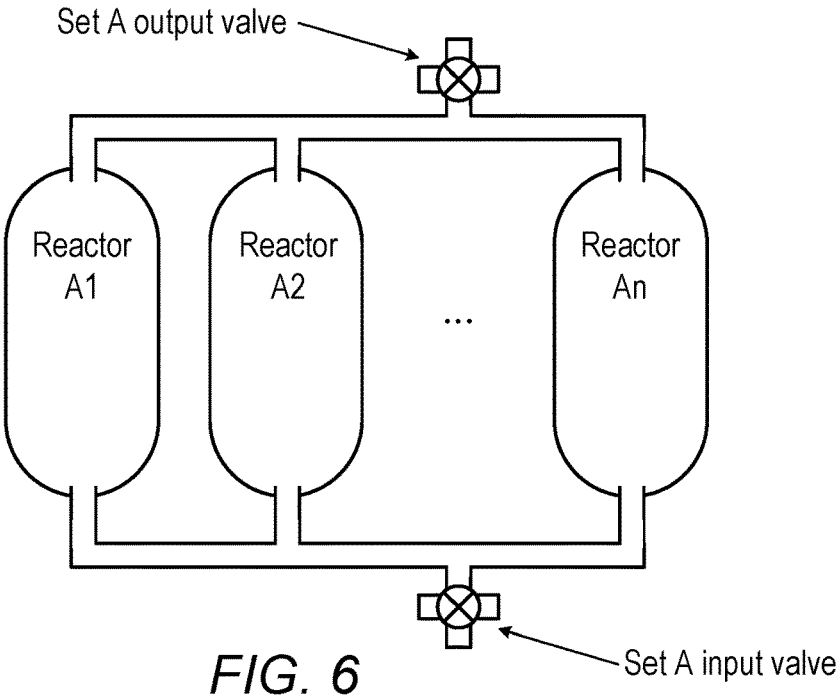
FIG. 6 is a schematic representation of a set of reactors acting as a single cell unit.

As shown in FIG. 6, and as explained herein, each electrochemical cell may comprise one or more reactors arranged as a single operating cell, wherein all reactors within a single cell operate the same and under same conditions.

Figure 3C:
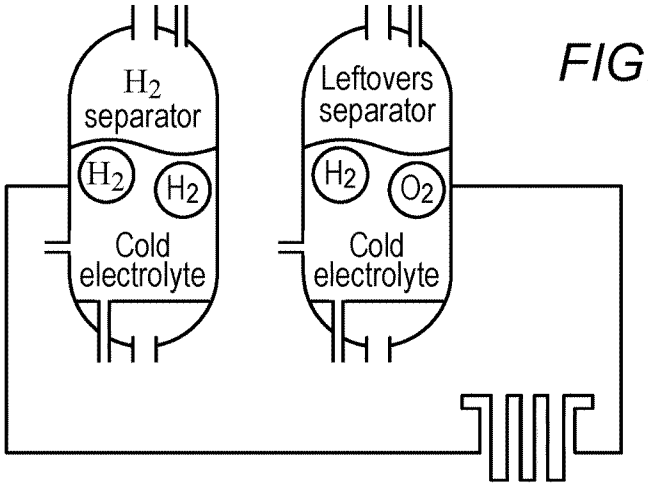
FIGS. 3A-C are general depiction of mechanical devices configured and operable to react to changes in volume and liquid levels, and are aimed to effectively reduce or diminish pressure fluctuations and avoid system malfunction.
Figure 3A:
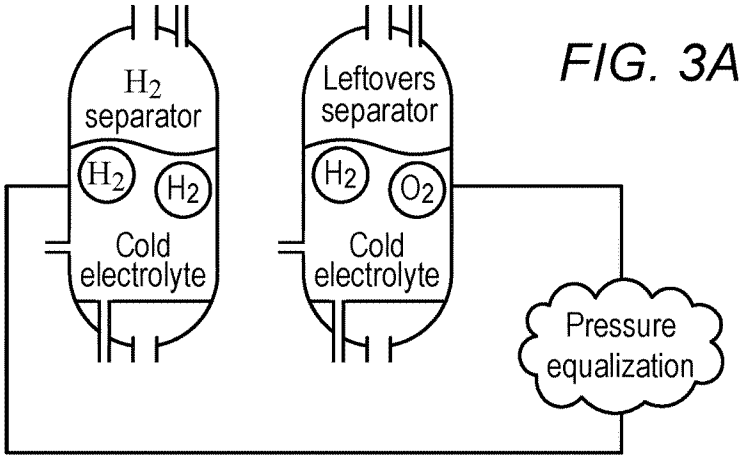
Figure 3B:
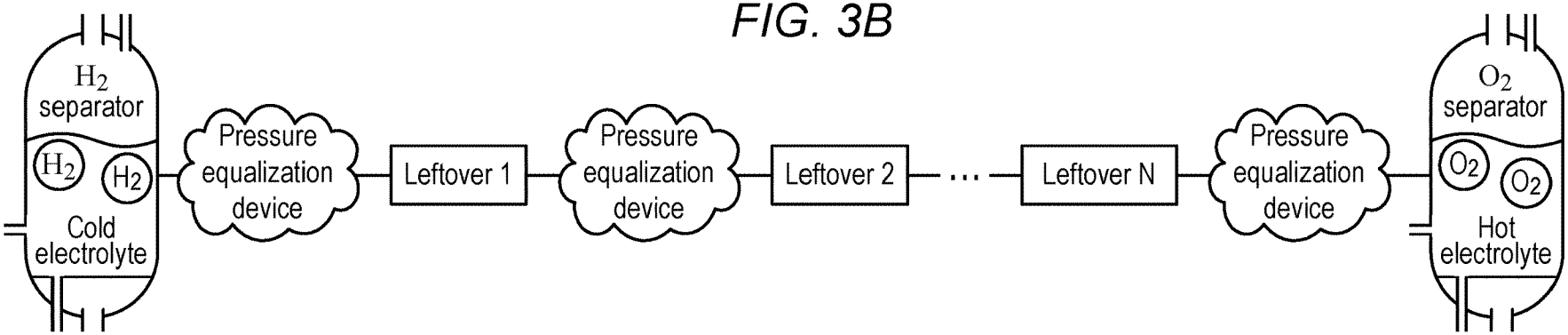

FIGS. 3A-C depict a gas-liquid separator system as shown in FIG. 1. A pressure activated device or a mechanical mechanism responsive to fluctuations in separator liquid volume, gas volume and pressure provides a solution for reducing or diminishing effective changes, as disclosed herein. A pressure activated device or a mechanical mechanism may be provided between a leftover gas-liquid separator (being an electrolyte reservoir) and an oxygen or a hydrogen separator (or electrolyte reservoirs) as shown in FIG. 3A. A number of such pressure activated devices or mechanical elements may be used between multiple leftover gas-liquid separators as shown in FIG. 3B. An external loop connecting between leftover gas-liquid separator and a hydrogen gas-liquid separator presented in FIG. 3C is an example of such pressure activated mechanism. This external loop unit is provided with a predetermined length or volume that can answer to pressure or volume fluctuations. The volume of the unit may be determined as explained hereinabove.

Figure 4:
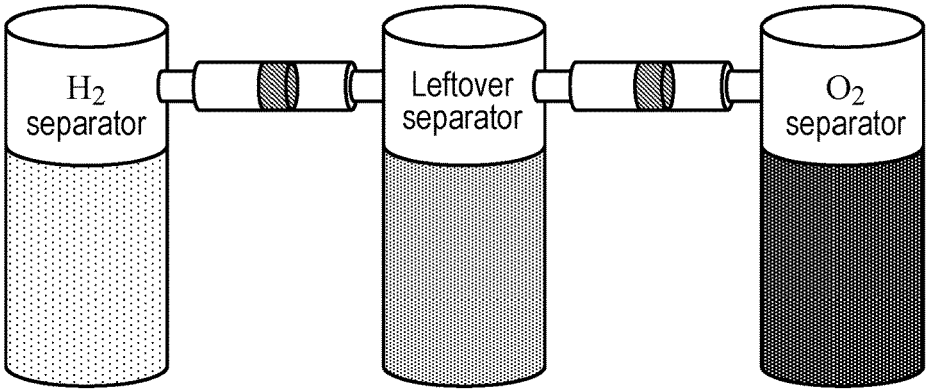
FIG. 4 is a schematic representation of a piston positioned at a top part of the separator, at a region of the separator occupied by a gas phase.
Figure 5:
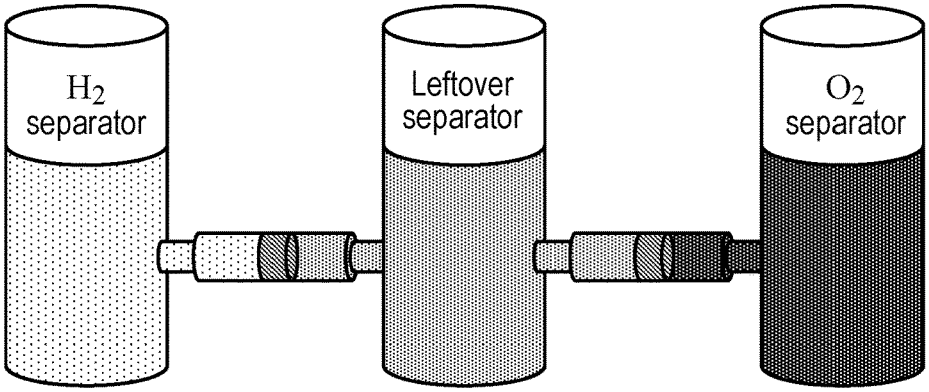
FIG. 5 is a schematic representation of a piston positioned at a lower part of the separator occupied by a liquid phase.

In some implementations of a system of the invention, a piston may be utilized as a pressure activated device. Use of a piston is demonstrated in FIGS. 4 and 5. It is of note that the piston may be replaced with any other pressure activated device or mechanical element or device capable of responding to volume or pressure fluctuations. The device or element may be positioned as shown in FIG. 4 or 5. In the particular example where a piston is used, it may be positioned above the gas-liquid interface, as shown in FIG. 4, thus to respond to changes in the gas volume or pressure by evacuating a gas volume or a liquid volume in case the separator is overflown with a liquid. Alternatively, it may be positioned below the gas-liquid interface, as shown in FIG. 5 and respond to such changes in a similar way.

Thus, when considering all FIGS. 1 through 6, a system of the invention (FIG. 1, 120), for producing hydrogen and oxygen gases, comprises:

at least two reactor cells (FIGS. 1, 130 and 140, Cell A and Cell B); and a plurality of gas-liquid separators (FIGS. 1, 170, 180 and 190), said plurality of gas-liquid separators comprising:

one or more hydrogen gas-liquid separator (FIG. 1, 180), each configured to receive and hold a liquid phase comprising dissolved hydrogen gas and electrolytes;

one or more oxygen gas-liquid separator (FIG. 1, 170), each configured to receive and hold a liquid phase comprising dissolved oxygen gas and electrolytes; and one or more leftover gas-liquid separator (FIG. 1, 190), each configured to receive and hold a substantially gas-free liquid or a liquid phase comprising dissolved hydrogen gas, oxygen gas or a mixture thereof, wherein the amount of the hydrogen gas, oxygen gas or a mixture thereof not exceeding 4% (v/v) (through a series of pipes (150) containing three or more distinct piping circuits (501), (502) and (503));

wherein each of the at least two reactor cells (FIGS. 1, 130 and 140, Cell A and Cell B) is provided with an outlet configured and operable to discharge a fluid (FIGS. 1, 136 and 146) and a feed inlet for flowing in a fluid (FIGS. 1, 132 and 142), i.e., following the PUSH sequences described hereinabove; and wherein at least one of the plurality of gas-liquid separators is adapted with a pressure activated device or a mechanical device configured and operable to reduce pressure changes in the at least one gas-liquid separator in response to pressure fluctuations derived from discharging the reactor content to the gas-liquid separator (as depicted in FIGS. 3A-3C and FIGS. 4 and 5).

The invention claimed is:

1. A system for continuous generation of hydrogen gas and oxygen gas, the system comprising a plurality of reactor cells and a plurality of gas- liquid separators, wherein each of the reactor cells is configured for holding an aqueous solution and comprising at least one electrode assembly, and is configured to have a dual function such that during application of electric bias to one or more of the cells hydrogen gas is generated and in absence of an applied bias to one or more of the cells oxygen gas is generated, wherein each of the plurality of reactor cells is separated, having essentially no fluid or gas communication therebetween, wherein the plurality of gas-liquid separators comprises:

one or more hydrogen gas-liquid separator, each hydrogen gas-liquid separator being configured to receive and hold hydrogen gas and a liquid phase comprising dissolved hydrogen and electrolytes;

one or more oxygen gas-liquid separator, each oxygen gas-liquid separator being configured to receive and hold oxygen gas and a liquid phase comprising dissolved oxygen and electrolytes; and one or more leftover separator, each leftover separator being configured to receive and hold a gas-free liquid, or to hold a liquid comprising an amount below 4% v/v of hydrogen gas or oxygen gas;

wherein any one of the reactor cells is connected to each of the separators via a piping assembly, forming three distinct circuits: a hydrogen circuit-wherein each of the plurality of reactor cells is connected to a hydrogen gas-liquid separator, an oxygen circuit-wherein each of the plurality of reactor cells is connected to an oxygen gas-liquid separator, and a leftover circuit-wherein each of the plurality of reactor cells is connected to a leftover gas-liquid separator, and wherein each of the reactor cells is equipped with input and output valves for controlling flow of liquid into the reactor cells and from the reactor cells such that following completion of a gas generation step, being one of a hydrogen generation step or an oxygen gas generation step, in one or more of the plurality of reactor cells, the input valve(s) of the one or more reactor cells switches from the gas circuit being the hydrogen gas circuit or the oxygen circuit, respectively, to the leftover circuit permitting flow of the liquid from the leftover separator into the one or more reactor cells, while the output valve(s) of the one or more reactor cells remains oriented to permit flow of content from the one or more reactor cells to the separator containing the hydrogen gas or oxygen gas, wherein liquid flow from the leftover separator pushes the electrolyte in the one or more reactor cells into a gas separator of the gas circuit, thereafter the output value(s) switches to allow the other of hydrogen gas generation step and oxygen gas generation step.

2. The system according to claim 1, wherein at least one of the plurality of gas-liquid separators is adapted with a pressure activated device or a mechanical device configured and operable to reduce pressure changes in the at least one gas-liquid separator in response to pressure fluctuations derived from discharging the reactor content to the gas-liquid separator.

3. A system for producing hydrogen and oxygen gases, the system comprising:

at least two reactor cells; and a plurality of gas-liquid separators, said plurality of gas-liquid separators comprising:

one or more hydrogen gas-liquid separator, each hydrogen gas-liquid separator configured to receive and hold a liquid phase comprising dissolved hydrogen gas and electrolytes;

one or more oxygen gas-liquid separator, each oxygen gas-liquid separator configured to receive and hold a liquid phase comprising dissolved oxygen gas and electrolytes; and one or more leftover gas-liquid separator, each leftover gas-liquid separator configured to receive and hold a substantially gas-free liquid or a liquid phase comprising dissolved hydrogen gas, oxygen gas or a mixture thereof, wherein the amount of the hydrogen gas, oxygen gas or a mixture thereof not exceeding 4% (v/v);

each of the at least two reactor cells is provided with a feed outlet configured and operable to discharge the gas-containing content to a gas-liquid separator comprising the same gas, and with a feed inlet for flowing a leftover liquid into the reactor cell, for displacing the reactor cell full content with a leftover liquid from the one or more leftover gas-liquid separator;

wherein at least one of the plurality of gas-liquid separators is adapted with a pressure activated device or a mechanical device configured and operable to reduce pressure changes in the at least one gas-liquid separator in response to pressure fluctuations derived from discharging the reactor content to the gas-liquid separator.

4. The system according to claim 3, wherein one or more of the oxygen gas-liquid separator and one or more of the hydrogen gas-liquid separator are connected via said pressure activated device to one or more of the leftover gas-liquid separator.

5. The system according to claim 3, wherein each of the at least two reactor cells is configured and operable to discharge a hydrogen content to a hydrogen gas-liquid separator, by actively displacing the full reactor cell content with a liquid from the one or more leftover gas-liquid separator; followed by replacing the leftover liquid in the reactor cell with a liquid from the oxygen gas-liquid separator.

6. The system according to claim 3, wherein each of the at least two reactor cells is configured and operable to discharge an oxygen content to an oxygen gas-liquid separator, by actively displacing the full cell content with a liquid from the one or more leftover gas-liquid separator; followed by replacing the leftover liquid in the reactor cell with a liquid from the hydrogen gas-liquid separator.

7. The system according to claim 3, wherein the pressure activated device is a linear or non linear pressure activated means.

8. The system according to claim 3, wherein the pressure activated device is a reciprocating device configured and operable for reducing pressure caused by an inlet flow into a separator.

9. The system according to claim 3, wherein the pressure activated device is a piston connecting a leftover gas-liquid separator and a hydrogen or oxygen gas-liquid separator.

10. The system according to claim 3, wherein the pressure activated device having a volume selected to be proportional to the electrolyte volume in the reactor or set of reactors.

11. The system according to claim 3, wherein the pressure activates device is in a form of a size-or volume-modifiable gas-liquid separator capable of reacting to pressure fluctuations by increasing or decreasing its size or volume.

12. The system according to claim 3, wherein the pressure activated device is in a form of tubing or a channel connecting the gas-liquid separators.

13. The system according to claim 12, wherein the tubing or channel having a volume determined by the multiplicity of reactor volume or sets of reactors according to Eq. 1:

$$\text{volume}_{(H2\ or\ O2\text{-}leftover)} = \|\text{“+”}_{(H2\ or\ O2)} - \text{“−”}_{(H2\ or\ O2)}\| \times \text{Set or Reactor volume} \qquad \text{Eq. 1.}$$

14. The system according claim 12, wherein the tubing or channel is configured and operable to hold a volume of liquid from each of the separators and operate, upon an increase in the pressure in one of the separators, as a piston flow unit or as a plug flow unit.

15. The system according to claim 14, wherein the volumes of liquid from each of the separators are separated by a movable solid barrier positioned along the tubing or channel length.

* * * * *